US008130151B2

(12) United States Patent
Tai et al.

(10) Patent No.: US 8,130,151 B2
(45) Date of Patent: Mar. 6, 2012

(54) MONOPOLE ANTENNA WITH ULTRA WIDE BAND

(75) Inventors: Lung-Sheng Tai, Tu-Cheng (TW); Chun-Ming Chiu, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 335 days.

(21) Appl. No.: 12/423,022

(22) Filed: Apr. 14, 2009

(65) Prior Publication Data

US 2009/0256770 A1 Oct. 15, 2009

(30) Foreign Application Priority Data

Apr. 14, 2008 (TW) ..... 097113433

(51) Int. Cl.
*H01Q 1/38* (2006.01)

(52) U.S. Cl. ..... 343/700 MS; 343/846

(58) Field of Classification Search ..... 343/700 MS, 343/846

See application file for complete search history.

(56) References Cited

U.S. PATENT DOCUMENTS 6,864,842 B2 * 3/2005 Hung et al. ..... 343/700 MS

* cited by examiner

*Primary Examiner* — Hoang V Nguyen

(74) *Attorney, Agent, or Firm* — Wei Te Chung; Andrew C. Cheng; Ming Chieh Chang

(57) ABSTRACT

A monopole antenna includes a base board with a first side and a second side, a radiating element, a grounding element and a feeding line. The radiating element and the grounding element are located on the first side of the base board. The grounding element is two times longer than the radiating element. The feeding line includes an inner conductor connected to the radiating element and an outer conductor connected to the grounding element.

16 Claims, 4 Drawing Sheets

MONOPOLE ANTENNA WITH ULTRA WIDE BAND

BACKGROUND OF THE INVENTION

1. Field of the Invention

The present invention relates generally to a monopole antenna, and more particularly to a monopole antenna with ultra wide band and suitable for building into an electronic device, such as a notebook.

2. Description of the Prior Art

At present, Ultra Wide Band (UWB) antennas are widely used to receive and send signals in Wireless Personal Area Network (WPAN). UWB technology owns higher transmitting rate, excellent security, and costs lower power and cost than conventional wireless transmitting technology in WPAN. Thus, more and more UWB antennas are integrated in electrical devices. Each conventional printed UWB antenna with monopole-antenna structure usually comprises a radiating portion and a grounding portion respectively arranged on two sides of the printed circuit board. However, the type above is complex.

Hence, in this art, a monopole antenna to overcome the above-mentioned disadvantages of the prior art should be provided.

BRIEF SUMMARY OF THE INVENTION

A primary object, therefore, of the present invention is to provide a monopole antenna with simple structure and ultra wide band.

In order to implement the above object, the monopole antenna includes a base board with a first side and a second side, a radiating element, a grounding element and a feeding line. The radiating element and the grounding element are located on the first side of the base board. The grounding element is two times longer than the radiating element. The feeding line includes an inner conductor connected to the radiating element and an outer conductor connected to the grounding element.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
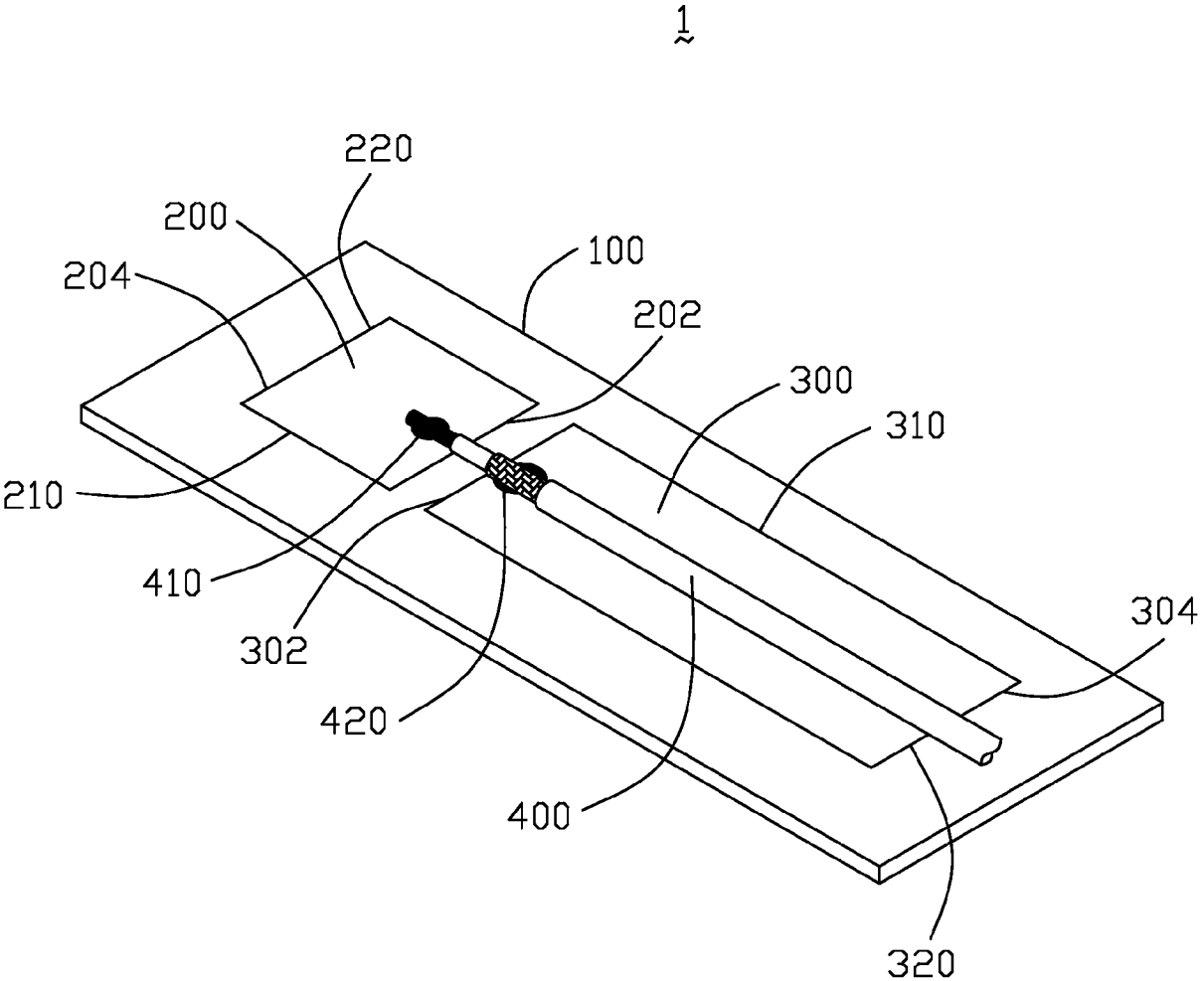
FIG. 1 is a perspective view illustrating a first embodiment of a monopole antenna in according with the present invention.

Reference to FIG. 1, a monopole antenna 1 in according with a first embodiment of the present invention is shown. The monopole antenna 1 comprises a base board 100 defining a first side (not labeled) and a second side (not labeled), a radiating element 200 located on the first side of the base board 100 and a grounding element 300 located on the first side of the base board 100, and a feeding line 400 connecting the radiating element 200 with the grounding element 300. In this embodiment, the base board 100 is a printed circuit board and the radiating element 200, the grounding element 300 are made by etching a metal layer on the printed circuit board. In other embodiment, the radiating element 200 and grounding element 300 can also be made from a metal foil and then be attached on an insulative base board.

The radiating element 200 is of rectangular shape, and comprises a proximal end 202 facing to the grounding element 300 and a far end 204 far from the grounding element 300. A pair of longer first sides 210, the length of which are 12 mm, connects the proximal end 202 with the far end 204. A pair of shorter second sides 220, the length of which are 10 mm, is respectively located on the proximal end and the far end. Thus, the radiating element 200 has a length of 12 mm and a width of 10 mm.

The grounding element 300 is rectangular, and comprises a first end 302 adjacent to the radiating element 200 and a second end 304 far from the radiating element 200. A pair of longer first sides 310, the length of which are 30 mm, connects the first end 302 with the second end 304. A pair of shorter second sides 320, the length of which are 10 mm, is located on the first end 302 and the second end 304. Thus, the grounding element 300 has a length of 30 mm and a width of 10 mm.

The feeding line 400 comprises an inner conductor 410 connected to the radiating element 200 and an outer conductor 420 connected to the grounding element 300.

The radiating element 200 is separated from the grounding element 300, and a certain distance is between the radiating element 200 and the grounding element 300. In this embodiment, the length of the distance is 1 mm. The grounding element 300 has a longer length than the radiating element 200 and a width equal to the width of the radiating element 200.

Figure 4:
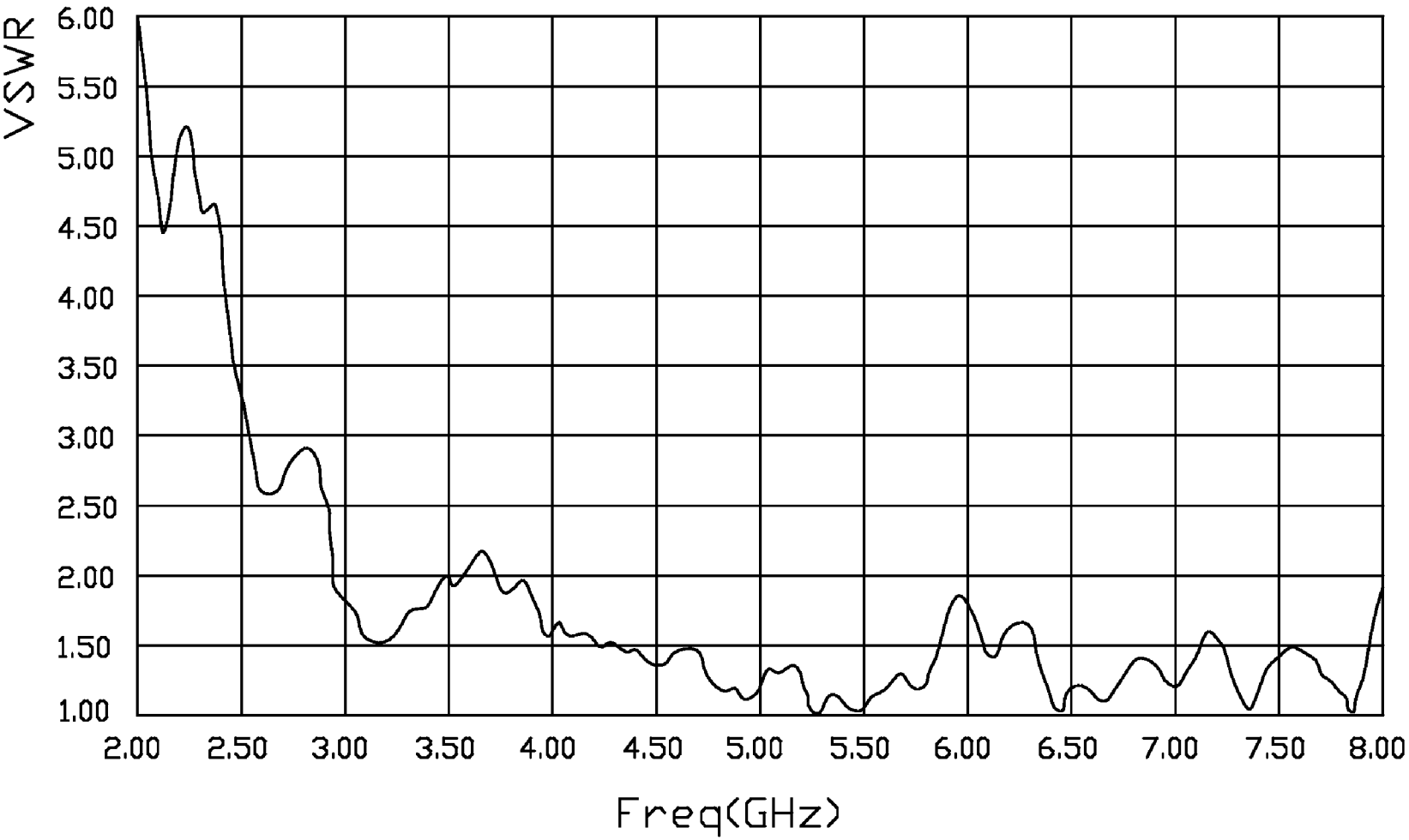
FIG. 4 is a test chart recording for the monopole antenna of FIG. 1, showing Voltage Standing Wave Ratio (VSWR) as a function of UWB frequency.

The monopole antenna 1 resonates a first higher frequency band on 7 GHz and a second lower frequency band on 3.5 GHz. The total length of the radiating element 200 and the grounding element 300, which is of 42 mm, is equal to half a wavelength of the 3.5 GHz frequency. Thus, the radiating element 200 together with the grounding element 300 resonates the lower frequency band of 3.5 GHz. The length of the radiating element 200 equals to a quarter of wavelength of the 7 GHz frequency. Thus, the radiating element 200 resonates the higher frequency band of 7 GHz. In addition, the radiating element 200 and the grounding element 300 together produce a double frequency effect, which serves as a complementarity for the higher frequency. The higher frequency band and the lower frequency band are connected to each other to form an ultra wide band. Referencing to FIG. 4, the VSWR of the monopole antenna 1 shows the monopole antenna works on a frequency band on 3 GHz-8 GHz.

In other embodiments, the width and structure of the radiating element 200 and the grounding element 300 can be changed to adapt for different needs, but the length of the radiating element 200 and the grounding element 300 can not be changed. Through the change of the radiating element 200 and the grounding element 300, the monopole antenna 1 can achieve higher frequency.

Figure 2:
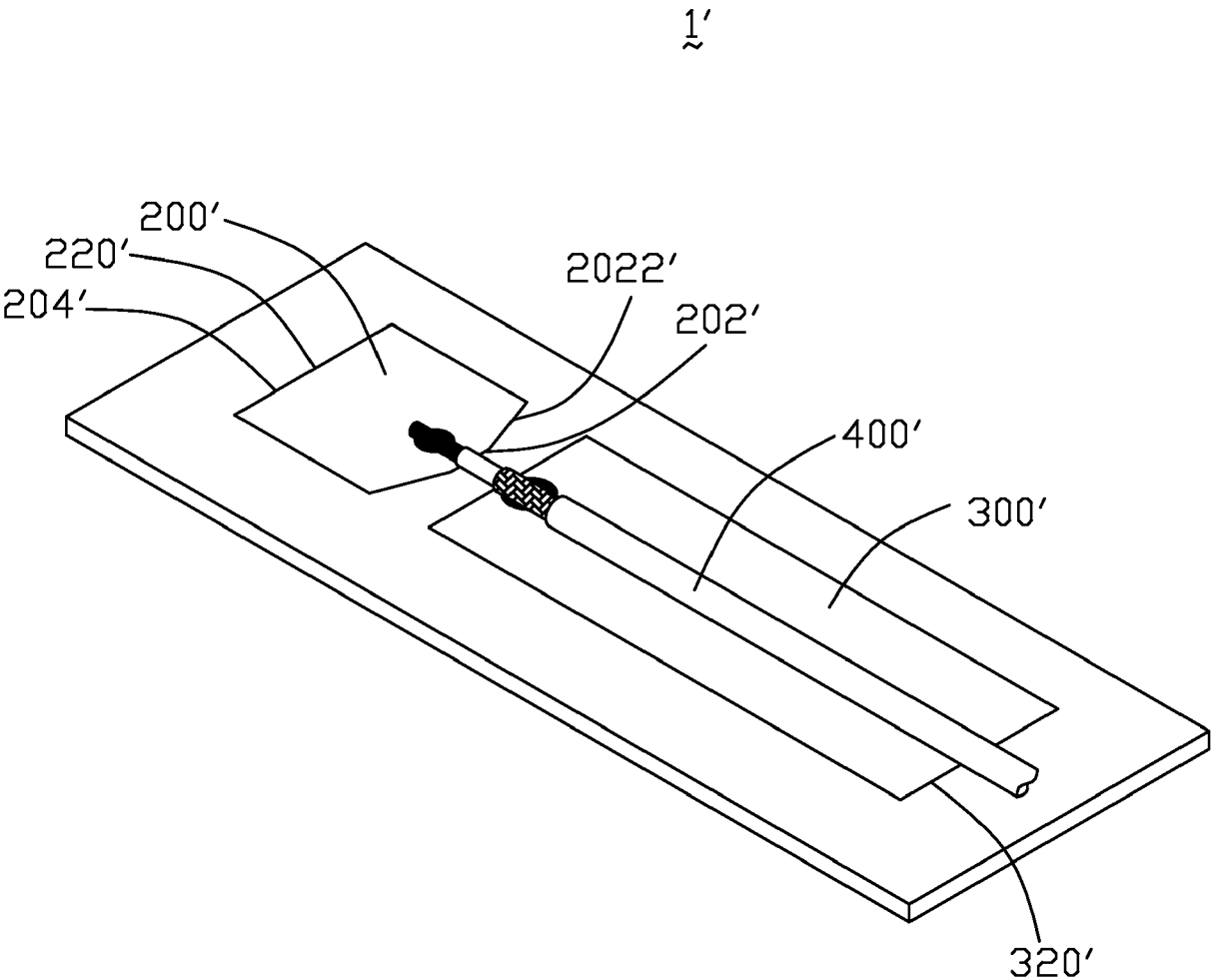
FIG. 2 is a perspective view illustrating a second embodiment of a monopole antenna in according with the present invention.

Referencing to FIG. 2, a monopole antenna 1' in according with a second embodiment of the present invention is shown. In this embodiment, the monopole antenna 1' comprises a radiating element 200', a grounding element 300' and a feeding line 400'. The difference from the monopole antenna 1 of the first embodiment is the proximal end 202' of the radiating element 200' has a pair of bevel edge 2022' to make the proximal end 202' is narrower than the far end 204'. The second side 220' on the far end 202' is parallel to the second side 320' of the grounding element 300'. The design owned bevel edge 2022' make the monopole antenna 1' achieve wider band width.

Figure 3:
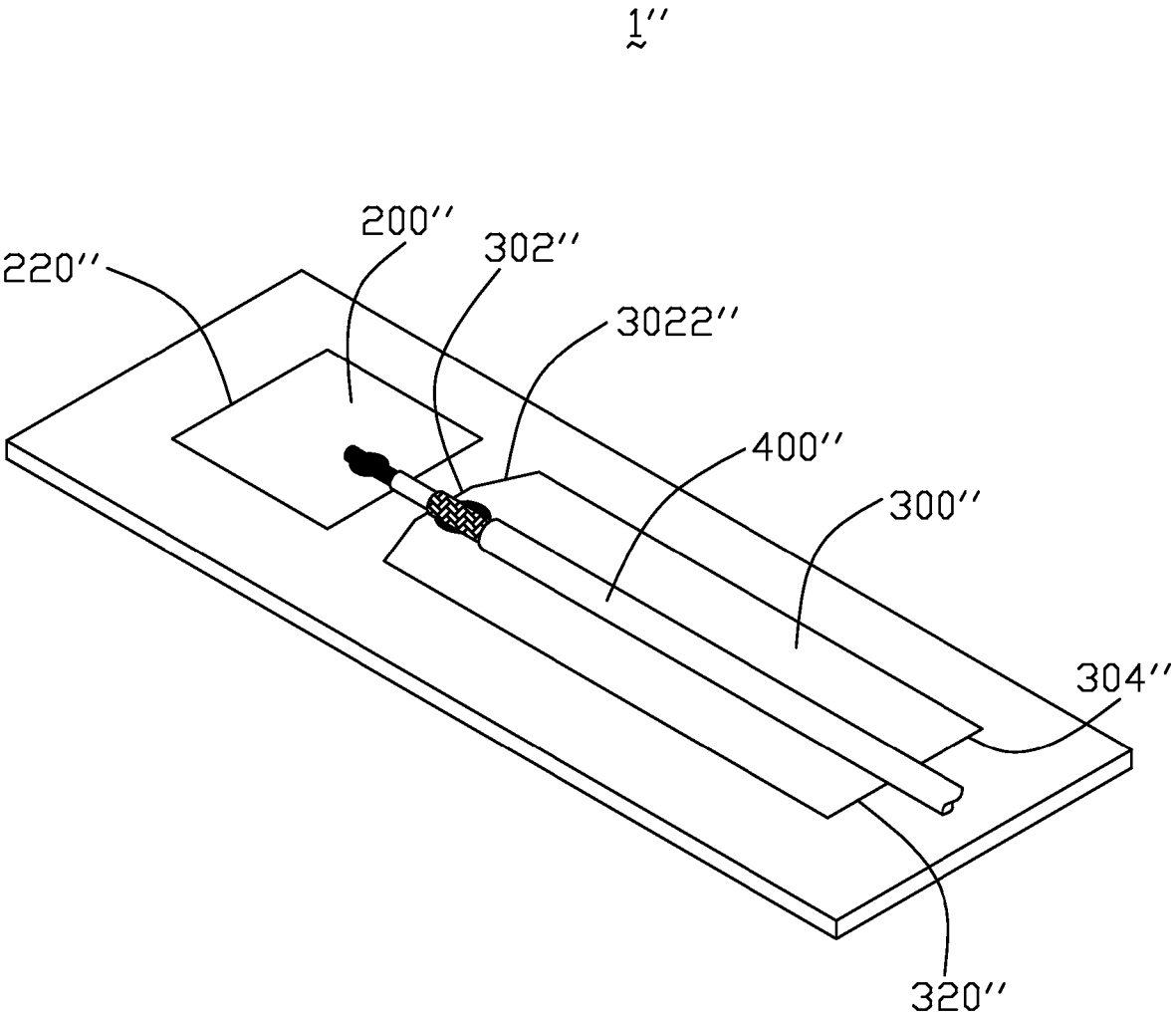
FIG. 3 is a perspective view illustrating a third embodiment of a monopole antenna in according with the present invention.

Referencing to FIG. 3, a monopole antenna 1" in according with a third embodiment of the present invention is shown. In this embodiment, the monopole antenna 1" comprises a radiating element 200", a grounding element 300" and a feeding line 400". The difference from the monopole antenna 1 of the first embodiment is the first end 302" of the grounding element 200" has a pair of bevel edge 3022" to make the first end 302" is narrower than the second end 304". The second side 320" on the second end 304" is parallel to the second side 220" of the radiating element 200". The design owned bevel edge 3022" make the monopole antenna 1" work at wider band width.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A monopole antenna, comprising:

a base board with a first side and a second side;

a radiating element located on the first side of the base board;

a grounding element located on the first side of the base board and being at least two times longer than the radiating element; and a feeding line comprising an inner conductor connected to the radiating element and an outer conductor connected to the grounding element; wherein said radiating element comprises a longer first side and a shorter second side; wherein said grounding element comprises a longer first side and a shorter second side; wherein said radiating element and said grounding element are both of rectangular configuration.

2. The monopole antenna as claimed in claim 1, wherein said radiating element is of rectangular configuration, and the grounding element comprises a first end adjacent to the radiating element and a second end far from the radiating element.

3. The monopole antenna as claimed in claim 2, wherein an edge of the second end of the grounding element is parallel to the second side of the radiating element, and the first end of the grounding element comprises a pair of bevel edges to make the first end narrower than the second end.

4. The monopole antenna as claimed in claim 1, wherein said grounding element is of rectangular configuration, and the radiating element comprises a proximal end facing to the grounding element and a far end far from the grounding element.

5. The monopole antenna as claimed in claim 4, wherein said second side on the far end of the radiating element is parallel to the second side of the grounding element, and the proximal end of the radiating element comprises a pair of bevel edges to make the proximal end narrower than the far end.

6. The monopole antenna as claimed in claim 1, wherein said radiating element resonates a first higher frequency band and the radiating element together with the grounding element resonates a second lower frequency band.

7. The monopole antenna as claimed in claim 6, wherein the center frequency of the first frequency band is of 7 GHz and the center frequency of the second frequency band is of 3.5 GHz.

8. The monopole antenna as claimed in claim 7, wherein the length of the radiating element equals to a quarter of the wavelength of the first center frequency, and the total length of the radiating element and the grounding element equals to a half of the wavelength of the second center frequency.

9. The monopole antenna as claimed in claim 1, wherein the length of the first side of the radiating element is of 12 mm and the length of the first side of the grounding element is of 30 mm.

10. The monopole antenna as claimed in claim 1, wherein said length of the second side of the radiating element equals to the length of the second side of the grounding element.

11. The monopole antenna as claimed in claim 10, wherein said length of the second side of each of the radiating element and the grounding element is 10 mm.

12. The monopole antenna as claimed in claim 1, wherein said base boar is a printed circuit board.

13. The monopole antenna as claimed in claim 1, wherein said monopole antenna is an ultra wide band antenna.

14. A monopole antenna, comprising:

a base board with a first side and a second side;

a radiating element located on the first side of the base board;

a grounding element located on the first side of the base board and being at least two times longer than the radiating element; and a feeding line comprising an inner conductor connected to the radiating element and an outer conductor connected to the grounding element; wherein said radiating element comprises a longer first side and a shorter second side; wherein said grounding element comprises a longer first side and a shorter second side; wherein said grounding element is of rectangular configuration, and the radiating element comprises a proximal end facing to the grounding element and a far end far from the grounding element; wherein said second side on the far end of the radiating element is parallel to the second side of the grounding element, and the proximal end of the radiating element comprises a pair of bevel edges to make the proximal end narrower than the far end.

15. The monopole antenna as claimed in claim 14, wherein said radiating element resonates a first higher frequency band and the radiating element together with the grounding element resonates a second lower frequency band; wherein a center frequency of the first frequency band is of 7 GHz and a center frequency of the second frequency band is of 3.5 GHz, wherein a length of the radiating element equals to a quarter of a wavelength of the first center frequency, and a total length of the radiating element and the grounding element equals to a half of a wavelength of the second center frequency.

16. A monopole antenna, comprising: a base board with a first side and a second side;

a radiating element located on the first side of the base board;

a grounding element located on the first side of the base board and being at least two times longer than the radiating element; and a feeding line comprising an inner conductor connected to the radiating element and an outer conductor connected to the grounding element; wherein said radiating element resonates a first higher frequency band and the radiating element together with the grounding element resonates a second lower frequency band; wherein a center frequency of the first frequency band is of 7 GHz and a center frequency of the second frequency band is of 3.5 GHz; wherein a length of the radiating element equals to a quarter of a wavelength of the first center frequency, and a total length of the radiating element and the grounding element equals to a half of a wavelength of the second center frequency.

* * * * *